US005871223A

United States Patent [19]

Zanco

[11] Patent Number: 5,871,223

[45] Date of Patent: Feb. 16, 1999

[54] BOARD FOR SLIDING OVER SNOW PROVIDED WITH AUXILIARY EDGE ELEMENTS OF HEIGHT LESS THAN THAT OF THE BOARD

[75] Inventor: Alain Zanco, Voiron, France

[73] Assignee: Skis Rossignol SA, France

[21] Appl. No.: 642,939

[22] Filed: May 6, 1996

[30] Foreign Application Priority Data

May 22, 1995 [FR] France ..... 95 06332

[51] Int. Cl.[6] ..... A63C 5/00

[52] U.S. Cl. ..... 280/607; 280/609

[58] Field of Search ..... 280/607, 602, 280/609, 11.14, 608, 617, 636

[56] References Cited

U.S. PATENT DOCUMENTS 4,714,267 12/1987 Abondance et al. ..... 280/636 X 5,333,889 8/1994 Piegay et al. ..... 280/607 X 5,397,150 3/1995 Commier et al. ..... 280/607

5,496,053 3/1996 Abondance ..... 280/609

*Primary Examiner*—Robert J. Oberleitner

*Assistant Examiner*—Pamela J. Lipka

*Attorney, Agent, or Firm*—Parkhurst & Wendel

[57] ABSTRACT

A board for sliding over snow, or snow board, incorporating a non-plane synthetic top layer with elevated central part. The snow board is provided with lateral reinforcing members whose height is less than that of the board. The reinforcing members receive the multiple feet of a rigid platform in the form of a low table and intended to receive the bindings. At those spots, the lateral edge elements preferably present wider portions. Corresponding recesses are made in the shell, each adapted to receive a conjugate foot of the platform. The feet of the platform are preferably high enough for the platform to rest on the edge elements of the snow board only by its feet.

23 Claims, 6 Drawing Sheets

BOARD FOR SLIDING OVER SNOW PROVIDED WITH AUXILIARY EDGE ELEMENTS OF HEIGHT LESS THAN THAT OF THE BOARD

FIELD OF THE INVENTION

The present invention relates to a board for sliding over snow, such as a ski, a monoski, surf or like snow board, of which, at least in the binding mounting area, the top face is constituted by a layer of synthetic material, this top layer not being plane and presenting, in transverse section, an elevated central part, in the form of a shell, this snow board being provided, on each side, with auxiliary reinforcing members, whose height is less than that of the board in the same transverse section thereof, which support the corresponding edge of said top layer.

BACKGROUND OF THE INVENTION

A snow board or the like as defined hereinabove is made in accordance with the so-called "DUALTEC" concept (Registered Trademark filed by the firm SKIS ROSSIGNOL S.A.)

A transverse section made on a "DUALTEC"-type ski shows that it generally comprises:

- a lower sole for sliding, possibly bordered on each side by metal edges,
- a possible "lower" reinforcing layer which rests on this sole,
- a core which may for example be a core of wood or a core of polyurethane preferably obtained by a process of injection,
- auxiliary reinforcing members, whose height is less than that of the ski, forming longitudinal reinforcing members and positioned on each side of this core,
- an upper layer of plastic material, or top layer, whose inner face is possibly lined, over all or part of its width, with an "upper" reinforcing layer and which covers the ski from one edge to the other, bearing on either side of the board, directly or not, on each of said auxiliary reinforcing members.

These auxiliary reinforcing members, which are substantially perpendicular to the surface of the sole, do not form part of the concept, already generalized, of so-called "shell" skis, since, in that case, the top layer is a shell which bears directly on the lower edges of the ski. In the so-called "DUALTEC" concept, the effect of the reinforcing members is to improve the efficiency of the ski over an ordinary shell ski, in that they increase the efficiency of the transmission of the efforts, made by the skier on the upper face of the ski, to the lower metal edges, i.e. in fact to the sliding surface.

The invention proposes to improve, on a ski (or other snow board) made in accordance with the "DUALTEC" concept mentioned above, the transmission of the impulses of the skier to the snow, by optimalizing the connection of the bindings of the skier's boot to the ski or other snow board.

In fact, to obtain good efficiency, it is essential that the efforts made by the skier's boot be transmitted as directly as possible on the lower lateral arrises of the ski.

It is known to provide, in the binding mounting area, a plate or platform for superelevation of the bindings of the boot and receiving these bindings, this plate or platform being able to be positioned at a distance from the upper surface of the ski.

Such binding-elevating plates or platforms prove to be necessary at the present time due to the reduction, at the level of the binding mounting area, of the width of downhill skis, one consequence of which is a risk of skidding in a tight turn, as the boot, which projects laterally, touches the snow whenever contact of the edge is great. With sufficient superelevation, there is virtually no risk of the boot contacting the snow whenever the ski inclines considerably to the side, and the ski may therefore be used normally, particularly in slalom.

It should be recalled that binding mounting area is intended to mean the intermediate zone located between the front and the rear of the snow board and on which the boot bindings are mounted.

SUMMARY OF THE INVENTION

The invention therefore relates to a board for sliding over snow, or snow board, of which, at least in the runner, the top face is constituted by a layer of synthetic material, this top layer not being plane and presenting, in transverse section, a shell-shaped, elevated, central part, this board comprising auxiliary lateral members whose height is less, in the same transverse section, than that of the board, forming longitudinal reinforcing elements, and provided at least in the binding mounting area, this top layer bearing by its two lateral parts on either side of the board, directly or not, on each of said auxiliary reinforcing members, this snow board being equipped with at least one rigid platform for receiving and elevating the boot bindings, and being characterized:

- in that this rigid platform presents a cross-section in the form of an upturned U and is shaped to rest, by its feet and directly or not, on said lateral reinforcing edge elements,
- and in that said top layer of this board presents, on each side and at the level of each foot of said platform, a recess positioned and dimensioned to receive this foot, each of these recesses being of length corresponding substantially to that of the matching foot of the platform and of width equal to or greater than the width of the base of this foot which thus rests on virtually the whole of the recess.

The rigid platform advantageously comprises at least two feet.

According to an advantageous embodiment, the reinforcing members each present, over at least a limited length located in the binding mounting area and embracing said recesses, at least one portion clearly wider than the rest of the edge element.

The reinforcing members may either be located in the binding mounting area, the latter embracing the feet of said platform, or they may extend over the whole bearing length of the board.

The "bearing length" of a snow board or the like should be understood to mean the length of its surface in contact with the ground when the user is upright thereon.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
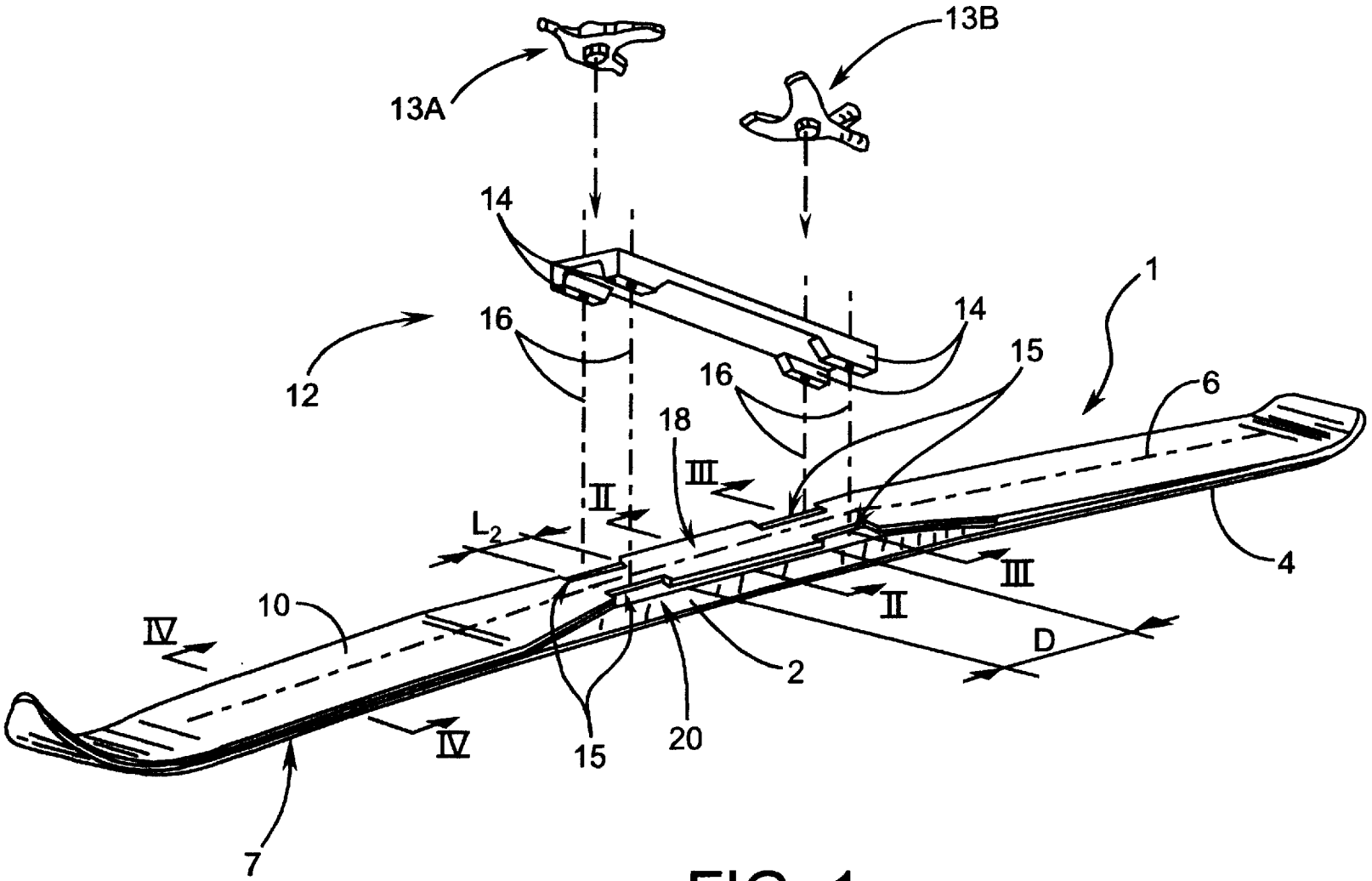
FIG. 1 is an overall view in perspective of a downhill ski according to the invention, with its platform for elevation of the bindings, and its bindings shown exploded.
Figure 2:
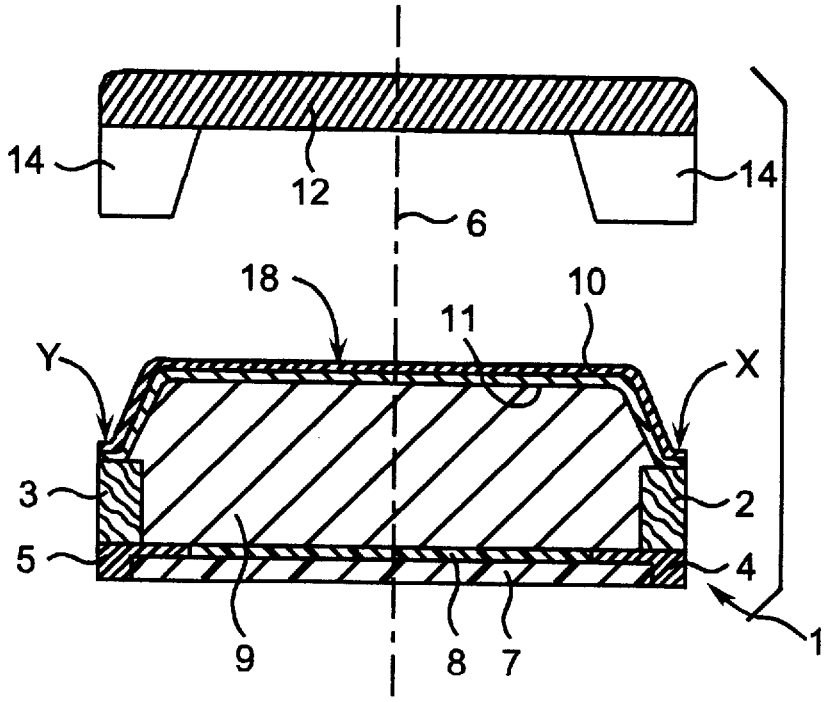
FIGS. 2 and 3 are views in section along II—II and III—III of FIG. 1, respectively.

Referring now to the drawings, and firstly to FIGS. 1 to 5, they illustrate an on-piste ski 1 or "Alpine ski", of the so-called "DUALTEC" type, provided on each side of the ski and in the binding mounting area, with a lateral reinforcing member 2, 3 resting on the respective lower edge 4, 5.

This ski is totally symmetrical with respect to its median longitudinal plane 6, and it comprises, visible in the same transverse section:

- a lower sole 7 for sliding, bordered on each side by metallic edges 4, 5;
- a lower reinforcing layer 8 which rests on this sole 7;
- a polyurethane core 9 obtained by a process of injection of the compounds of a polyurethane foam;
- bordering this core on either side, at the level of the binding mounting area: the two lateral auxiliary reinforcing members 2, 3 of height less than that of the ski and forming longitudinal reinforcing members and resting on the corresponding edges 4 and 5;
- an upper coating constituted by a layer of synthetic material and forming, in the runner zone, a shell 10 whose inner face is lined with an upper reinforcing layer 11, this shell bearing on either side, by two lateral flanges X and Y, on the two reinforcing members 2 and 3 in the median zone of the ski and on the edges 4 and 5 in the front and rear parts of this ski.

According to the invention, the ski 1 is provided to receive, in its binding mounting area, a rigid platform 12 for receiving and elevating the bindings 13A, 13B of the skier's boot.

Figure 3:
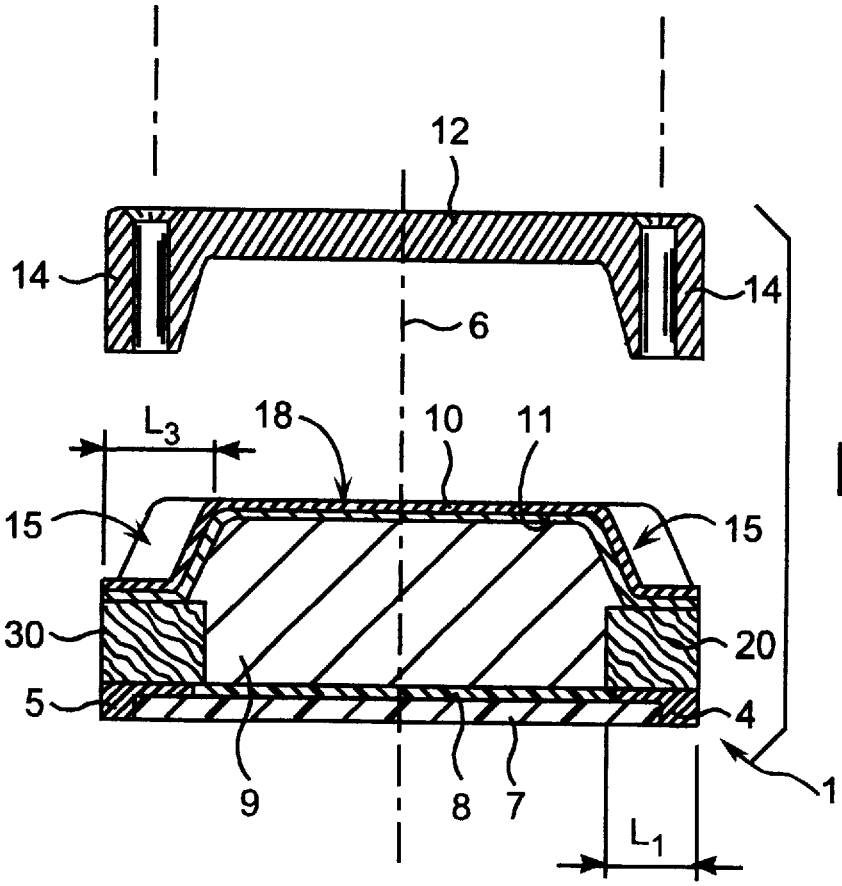
Figure 4:
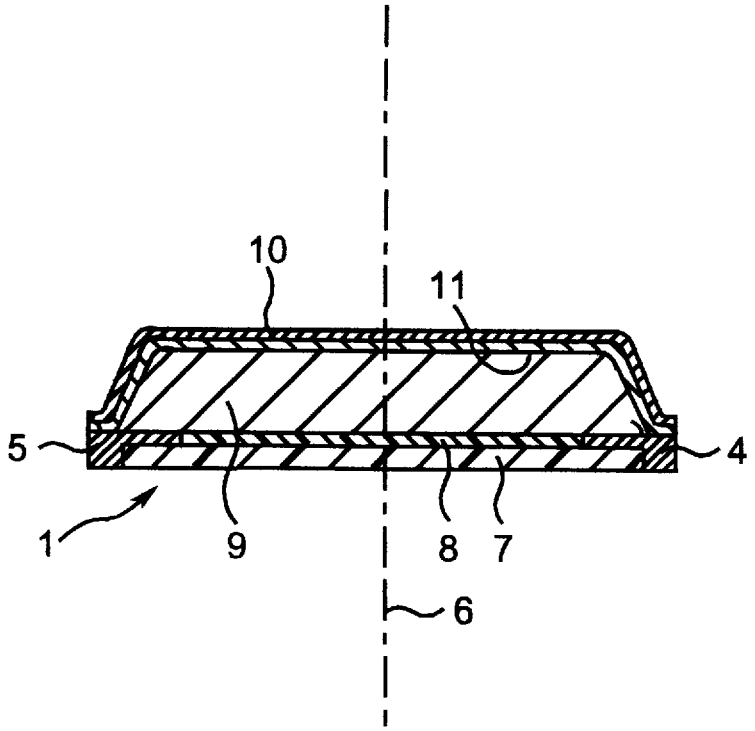
FIG. 4 is a section along IV—IV of FIG. 1.
Figure 5:
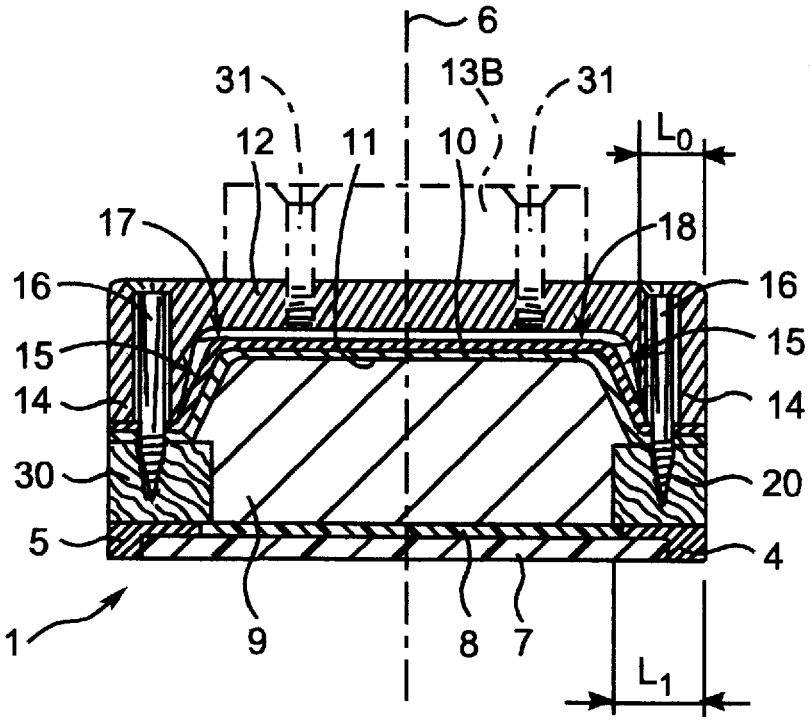
FIG. 5 is a view similar to FIG. 3, but with the platform placed in position on the ski.

This platform 12 is monolithic, consequently comprising only one upper plate. At least part of its cross section is in the form of an upturned U and it generally resembles a low table with four feet 14, each of these feet being fitted in four conjugate female recesses 15 in the shell of the ski 1, so as to rest firmly, in these recesses or notches 15, on the corresponding bearing surfaces 20 and 30 of the reinforcing members, these latter being consequently widened over the length of these recesses. As shown in FIGS. 3 and 5, the width L1 of the bearing surfaces 20 and 30 of the reinforcing members 2 and 3 has, over the length L2 of these recesses 15, a value equal to or greater than that, L0, of the corresponding, substantially flat and horizontal edge of the shell 10 (lined with its reinforcement 11), by which it rests on the corresponding lateral reinforcing member 2 or 3. Each of these recesses 15 is therefore of length L2 substantially corresponding to that of the conjugate foot 14 of the platform and of width L0 at least equal to the width of the base of this foot 14 which thus rests flat on virtually the whole of the recess 15.

The single platform 12 preferably presents at least three feet 14 by which it rests on the flanges of the shell and therefore on the corresponding edge elements 2 and 3, as it is thus more supple and lighter than a conventional platform incorporating continuous lateral flanges. By reason of its shape, this monolithic platform 12 makes it possible to separate the ski with respect to the boot binding, by guaranteeing a constant distance between the front stop and the rear heel of the binding.

In accordance with FIG. 5, the rigid platform 12 is fixed on the reinforcing members 2, 3 by means of screws 16 after the operation of positioning in the four recesses 15. In that case, it rests only on these reinforcing members 2, 3 by its feet 14 (here with the interposition of two layers of material constituted by the shell 10 and its reinforcement 11), as the latter are sufficiently high for a free space 17 to be made between the upper surface 18 of the ski and the lower face of this platform 12. The effort made by the skier is in that case exerted, via platform 12, its feet 14, and the reinforcing members 2, 3, directly on the edges 4, 5, which is the principal object of the invention.

The thickness and shape of the platform 12 are chosen so that the screws 31 for holding the bindings 13A, 13B do not penetrate in the shell 10.

To give an idea, the length L2 of each of the four recesses 15 advantageously has a value of the order of 3 centimeters, and the same obviously applies for the corresponding dimensions of each foot 14.

The longitudinal distance D between the two pairs of opposite recesses corresponds to a space, located in the binding mounting area, which is advantageously of the order of 40 centimeters.

It goes without saying that the invention is not limited to the embodiment which has just been described, and numerous variant embodiments may be envisaged.

For example, the platform 12 might itself be the base, conventionally made in the form of a slideway, for the binding of the boot, this platform and slideway therefore receiving the body of the front stop and/or of the heel.

In fact, it is known that a conventional binding generally comprises a base forming slideway, and therefore with a section in the form of a "closed U", this base allowing the body of the binding (front stop and/or rear) to slide longitudinally forwardly or rearwardly in order in particular to adjust the binding as a function of the skier's boot size. According to this particular feature of the invention, it is therefore this elevated platform 12 which also serves as slideway.

The existence of the widened bearing surfaces of the reinforcing members 2, 3 is thus not absolutely indispensable and, in a simplified embodiment of the invention, the feet 14 of platform 12 might be of a width (at the base) which is less than or preferably substantially equal to that, L1, of the reinforcing members 2 and 3.

Figure 6:
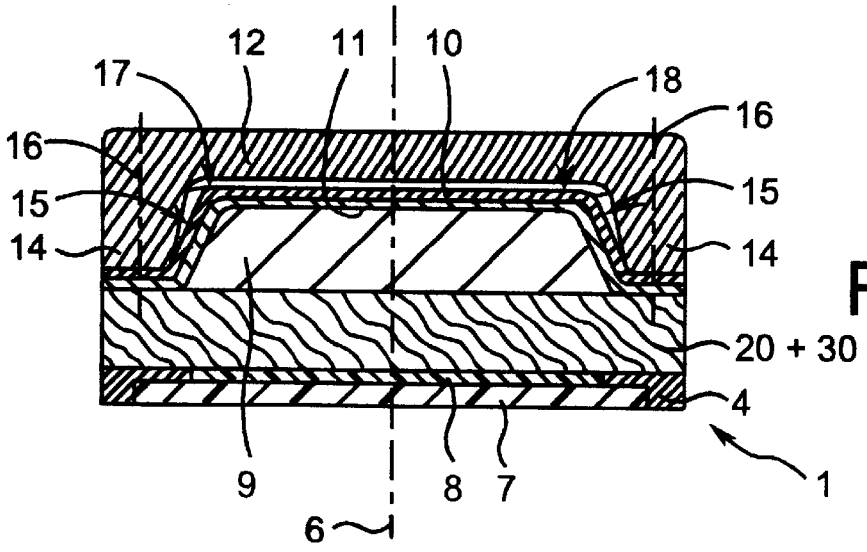
FIGS. 6, 7 and 8 are views similar to FIG. 5, and illustrating three first variant embodiments.
Figure 8:
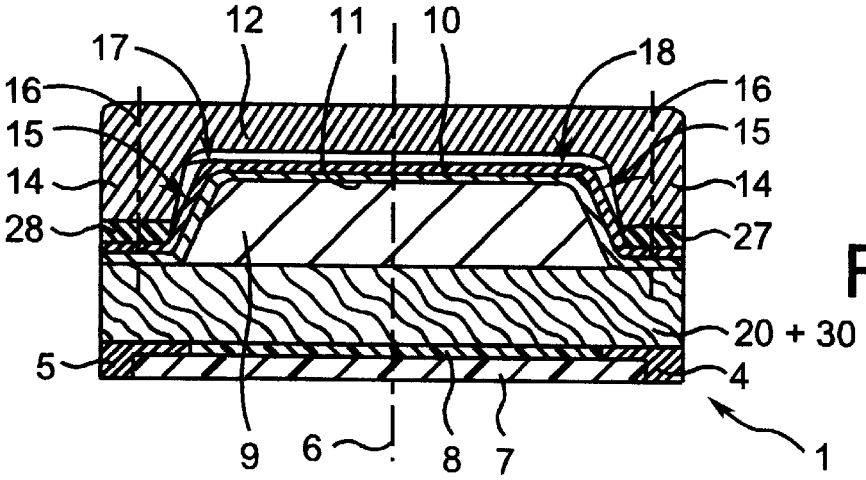

According to FIG. 6 and FIG. 8, the reinforced portions 20, 30 of the reinforcing members 2, 3 might, at the level of each recess 15, also extend at that spot in one piece (20+30) over the whole width of the ski 1.

Figure 7:
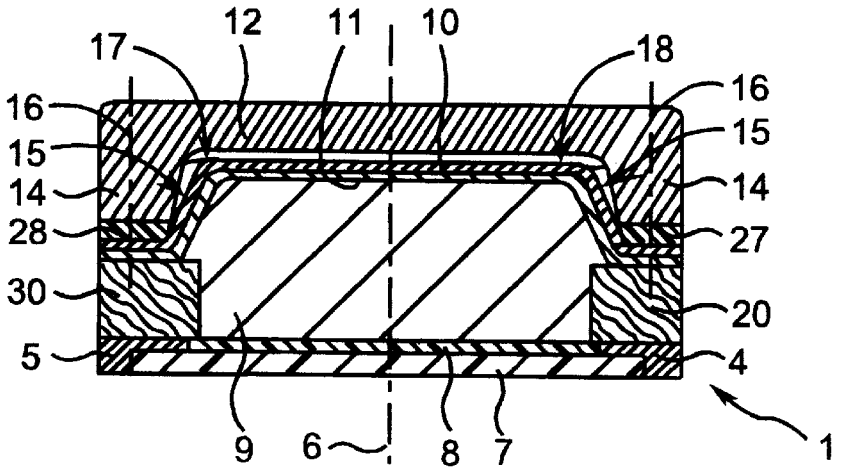

In accordance with FIGS. 7 and 8, a visco-elastic vibration-absorbing layer 27, 28 might also be provided on each of the reinforcing members 20, 30 at the level of the recesses 15 and preferably beneath each foot 14 of the platform (possibly with the interposition of layers 10 and 11 as shown in the drawing).

Instead of resting on the reinforcing members 2 and 3, whether it be question of widened parts 20 and 30 or not, via layers 10 (shell) and 11 (upper reinforcement), the feet 14 of the platform 12 might also either rest directly on these reinforcing members 2 and 3, in which case the layers 10 and 11 would be absent at that spot, or rest on these reinforcing members via one of these two layers, 10 or 11, and in that case the other layer 11 or 10 would then be absent at that spot, which would in no way prevent providing to interpose a visco-elastic layer between each foot 14 and the reinforcing members 2 or 3 on which it rests, directly or indirectly.

In a variant embodiment of the invention, the space 17 which is made between the platform 12 and the top 18 of the ski might be filled with a layer of visco-elastic material instead of being constituted by a simple layer of air.

This platform 12 might present six feet 14 instead of four, or even more, and an equal number of recesses 15 would then be provided in the ski 1.

According to another variant, the platform 12 might be disymmetrical with respect to its longitudinal axis, i.e. with respect to the median longitudinal plane 6 of the ski, and the same might possibly apply, in conjugate manner, for the possible widened portions 20, 30 of the reinforcing members 2, 3 as well as for their conjugate recesses 15 in the shell 10.

In particular, the platform 12 may have fewer feet 14 on the inner edge side of the ski, or more generaly on the inner side of the ski when the two skis are fitted on the skier's feet, than the other side (or outer side), in order to maintain bendability of the ski even more. For example, platform 12 may have only three feet 14, viz. one foot on the inner side of the ski (inner edge) and two feet on the outer side of the ski (outer edge).

The ski in question is not necessarily a ski provided with metallic edges. It may very well be question of a ski not presenting edges on its lower lateral arrises, as is the case at present for a large majority of cross-country skis.

Platform 12 is, here, a metallic platform, for example of aluminium alloy. It may also be of another rigid material such as a composite material (epoxy-glass fabric, reinforced polyurethane, . . . ).

Figure 13:
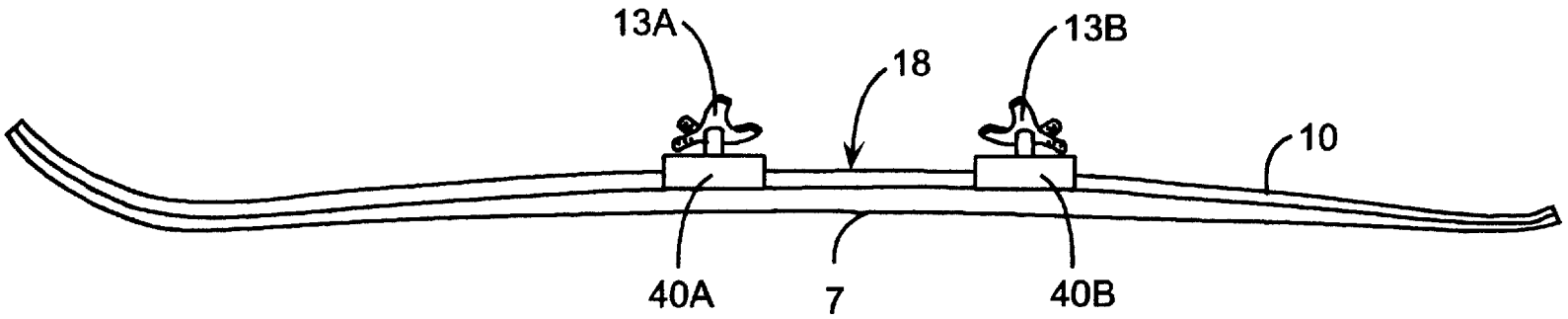
FIG. 13 shows an embodiment where the platform for receiving the bindings is constructed of two parts.

As shown in FIG. 13, instead of being monolithic, platform 12 for receiving the bindings 13A, 13B may be made in two parts, viz. a front part 40A receiving the front part 13A of the binding, or "stop", and a rear part 40B receiving the rear part 13B of the binding, or "heel". In such a case, the front part 40A of platform 12 is preferably provided to be anchored in the reinforcing members 2, 3 of the ski by fixing screws 16 or the like, in accordance with FIG. 5 for example, while the rear part 40B of this platform 12 comprises, like FIG. 7, shoes 27, 28 made of visco-elastic material beneath each of its feet 14, these visco-elastic layers 27, 28 on the one hand being glued beneath their respective feet 14 and being, on the other hand, respectively glued on the two receiving flanges X, Y of the shell 10, on which they respectively rest. This arrangement makes it possible to avoid rigidification of the ski still more efficiently.

Figure 9:
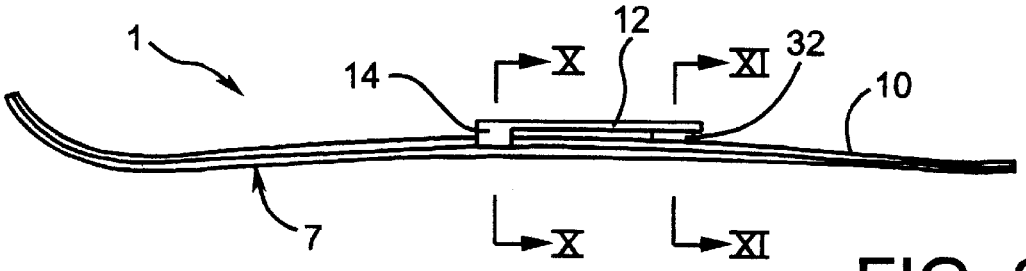
FIG. 9 is a side view of a downhill ski according to the invention, in another variant embodiment.
Figure 10:
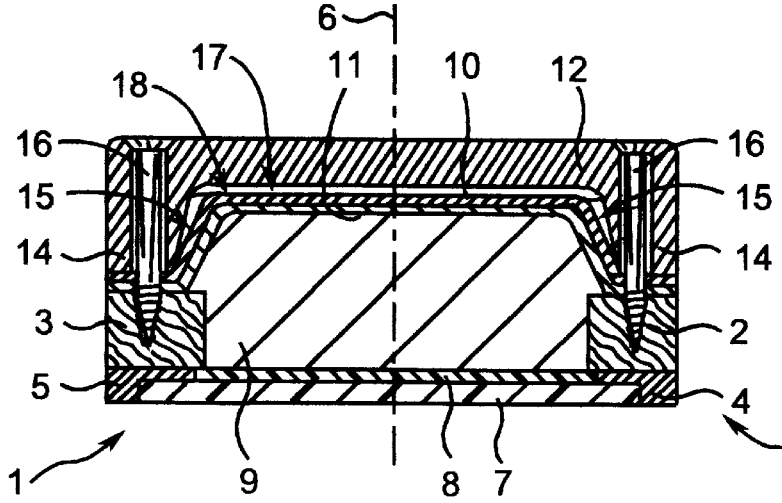
FIGS. 10 and 11 are transverse sections along X—X and XI—XI of FIG. 9 respectively.
Figure 11:
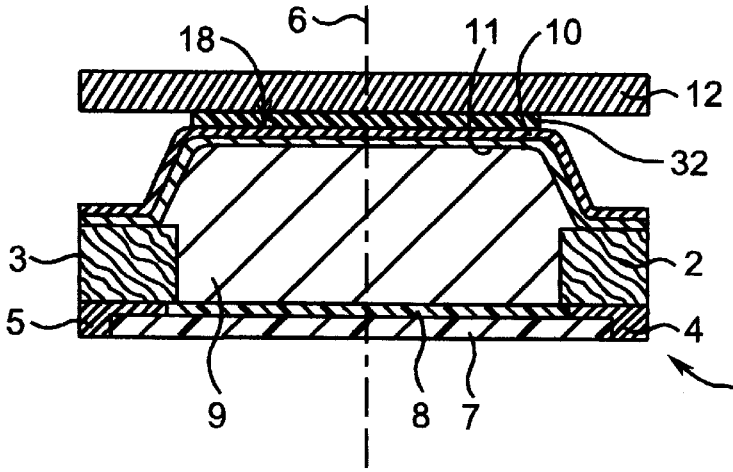

Another embodiment according to the invention, likewise very efficient for avoiding rigidification of the ski, is shown in FIGS. 9 to 11.

According to this embodiment, the platform 12, which is monolithic, presents feet 14 only at the front of this platform, by which it rests on the reinforcing members 2, 3, like all the platforms 12 described hereinbefore.

On the other hand, it does not present feet at the rear, but rests on the upper surface 18 of the ski via at least one visco-elastic wedge 32 which preferably extends over the whole width of this upper surface 18 and which is glued both on this surface 18 and beneath the platform 12.

Figure 12:
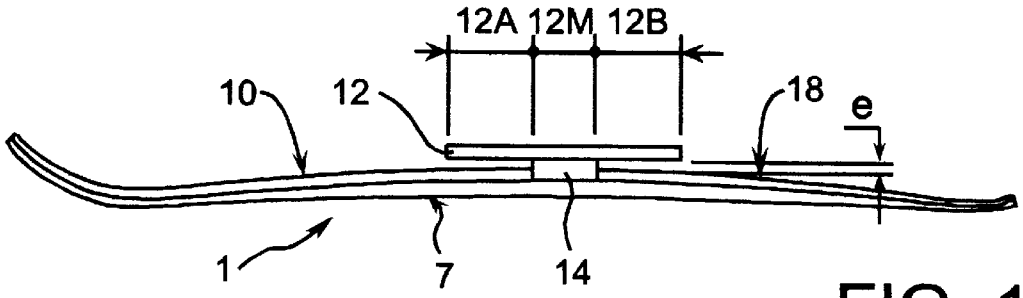
FIG. 12 is a view similar to FIG. 9, and illustrating a final variant embodiment.

Finally, FIG. 12 illustrates a last embodiment which differs from those of FIGS. 1 to 8 in that the platform 12, which is monolithic, present feet 14 only in its median longitudinal part 12M (for example, two feet are provided in the non-limiting example shown, but it may also be possible to provide four feet), with the result that its front part 12A and its rear part 12B are both in overhang with respect to this median part 12M, and are located at a short distance "e" above the upper surface 18 of the ski.

What is claimed is:

1. A board for sliding on snow, comprising:

a lower sole for sliding;

a core;

girder elements disposed substantially longitudinally in at least a binding mounting area of said board on each side of said core, said girder elements having a height less than that of the board;

a top face comprising synthetic material and having, at least in said binding mounting area, a shell-shape having (i) an upper portion forming an upper face of said board, (ii) lateral portions forming at least parts of opposed lateral faces of said board, and (iii) shoulders supported by upper portions of said girder elements, said top face defining on each lateral side of said board at least one recess; and a rigid platform, for receiving a binding mechanism, including feet and having an inverted U-shape cross-section, said feet being respectively positioned and dimensioned to correspond substantially to said recesses such that said feet are supported by each of said girder elements, wherein each of said recesses has a length corresponding substantially to that of a base of a corresponding foot of said platform and a width equal to or greater than the width of a base of a corresponding foot of said platform.

2. The board of claim 1, wherein said platform is monolithic and comprises only one upper plate.

3. The board of claim 2, wherein said platform comprises feet only at a forward part thereof, the rear part being supported on an upper surface of the board via a visco-elastic fastening means glued to said upper surface and to said platform.

4. The board of claim 3, wherein said visco-elastic fastening means extends over the whole width of said upper surface of the board.

5. The board of claim 2, wherein said platform comprises feet only at a median part thereof such that both a front part and a rear part thereof overhang the board.

6. The board of claim 1, wherein said platform comprises at least two distinct feet on at least one side thereof.

7. The board of claim 1, wherein said girder elements each present, at the position of each recess over at least a limited length in said binding mounting area, at least one portion that is wider than a remainder thereof.

8. The board of claim 7, wherein said girder elements extend over the entire width of the board and together comprise a single integral member.

9. The board of claim 1, wherein a visco-elastic layer for shock-absorption is provided beneath each of said feet of the platform.

10. The board of claim 1, wherein a gap is formed between said platform and a top surface of said top layer.

11. The board of claim 10, wherein the gap is filled with a visco-elastic material.

12. The board of claim 1, wherein said platform is disymmetrical with respect to its longitudinal axis.

13. The board of claim 12, wherein said feet of the platform are disposed disymmetrically with respect to the median longitudinal plane of the board.

14. The board of claim 13 wherein said platform comprises fewer feet on an inner edge side of the board than on an outer edge side thereof.

15. The board of claim 14, wherein said platform comprises one foot on the inner edge side thereof and two feet on the outer edge side thereof.

16. The board of claim 12, wherein corresponding parts of the board present disymmetries corresponding to those of said platform.

17. The board of claim 1, wherein said platform comprises a front part for receiving a stop and a rear, separate, part for receiving a heel of said binding mechanism.

18. The board of claim 17, wherein the front part of said platform is joined to said girder elements via screws and the rear part comprises feet comprised of visco-elastic material glued to both the rear part of said platform and a layer of the board.

19. The board of claim 1, wherein said girder elements extend over substantially the entirety of a bearing length of the board.

20. The board of claim 1, wherein said girder elements are disposed in said binding mounting area.

21. The board of claim 1, wherein said platform is shaped to constitute a slideway for receiving a body of a toe and/or a heel of a binding mechanism.

22. The board of claim 1, wherein said feet of said platform directly contact said girder elements.

23. The board of claim 1, wherein said feet rest on said girder elements via an intermediate layer.

* * * * *